US006422830B1

(12) United States Patent
Yamada et al.

(10) Patent No.: US 6,422,830 B1
(45) Date of Patent: Jul. 23, 2002

(54) FLUID MACHINE

(75) Inventors: Kiyohiro Yamada; Takeshi Imanishi; Masahiro Kawaguchi; Shingo Kumazawa, all of Kariya (JP)

(73) Assignee: Kabushiki Kaisha Toyoda Jidoshokki Seisakusho, Kariya (JP)

( * ) Notice: Subject to any disclaimer, the term of this patent is extended or adjusted under 35 U.S.C. 154(b) by 0 days.

(21) Appl. No.: 09/518,823

(22) Filed: Mar. 6, 2000

(30) Foreign Application Priority Data

Mar. 15, 1999 (JP) ..... 11-069033

(51) Int. Cl.[7] ..... F04B 1/26
(52) U.S. Cl. ..... 417/222.2
(58) Field of Search ..... 417/222.2, 263, 417/313; 210/416.1

(56) References Cited

U.S. PATENT DOCUMENTS

| | | | | |
|---|---|---|---|---|
| 3,894,855 A | | 7/1975 | Bidol | |
| 5,242,274 A | * | 9/1993 | Inoue | 417/222.2 |
| 5,557,945 A | * | 9/1996 | Mangyo et al. | 62/474 |
| 5,772,406 A | * | 6/1998 | Takai | 417/269 |
| 5,882,180 A | | 3/1999 | Kawaguchi et al. | |
| 6,015,269 A | * | 1/2000 | Ota et al. | 417/222.2 |
| 6,074,177 A | * | 6/2000 | Kobayashi et al. | 417/313 |
| 6,099,276 A | * | 8/2000 | Taguchi | 417/569 |
| 6,117,202 A | * | 9/2000 | Wetzel | 55/385.2 |
| 6,135,738 A | * | 10/2000 | Kajiwara et al. | 418/55.4 |
| 6,176,093 B1 | * | 1/2001 | Stein et al. | 62/85 |
| 6,189,333 B1 | * | 2/2001 | Cummings et al. | 62/474 |

FOREIGN PATENT DOCUMENTS

| | | |
|---|---|---|
| DE | 197 03 216 A | 8/1997 |
| JP | 58-158382 | 9/1983 |
| JP | 07-027049 A | 1/1995 |
| JP | 06 336978 A | 4/1995 |
| JP | 09-209929 A | 8/1997 |

OTHER PUBLICATIONS

EP 00 10 4566 Search Report dated Jan. 16, 2001.

* cited by examiner

*Primary Examiner*—Joseph Pelham
*Assistant Examiner*—Vinod D Patel
(74) *Attorney, Agent, or Firm*—Woodcock Washburn LLP

(57) ABSTRACT

A fluid machine, in which the step of mounting a filter on a flow passageway can be easily automated and the latitude of filter arrangement is improved. A mounting recess is formed on the inner bottom surface of a rear housing. An inlet to a gas feed passageway opens to the bottom of the mounting recess. A control valve for adjusting the displacement of the compressor is arranged on the way of the gas feed passageway. A filter including a support ring and a filter member made of a woven wire in a shape of a cylinder with one end covered is fixedly secured in the mounting recess by press fitting. The head of the filter member is formed to project beyond the inner bottom surface when the filter is mounted in the mounting recess.

16 Claims, 5 Drawing Sheets

FLUID MACHINE

BACKGROUND OF THE INVENTION

1. Field of the Invention

The present invention relates to a fluid machine for converting fluid energy to mechanical energy or vice versa, such as a compressor for compressing a gas.

2. Description of the Related Art

Regarding this type of fluid machine, a compressor suitable for use for a vehicular air-conditioning system configured, as described below, is known.

Specifically, a crank chamber is defined in a housing, and a drive shaft is rotatably supported by the housing across the crank chamber thereof. In the crank chamber, a swash plate acting as a cam plate is supported on the drive shaft via a rotatable support member to be able to rotate in synchronism with the drive shaft and be inclined with respect to a plane vertical to the axis of the drive shaft. A plurality of pistons are coupled to the outer peripheral portion of the swash plate. A cylinder block constituting a part of the housing is formed with a plurality of cylinder bores, at predetermined spatial intervals, at positions surrounding the drive shaft. The head of each piston is inserted into the corresponding one of the cylinder bores to be able to move reciprocally therein.

When the drive shaft is driven to be rotated by the driving force transmitted thereto, via a belt or the like, from an external drive source such as a vehicle engine, the swash plate is rotated via the rotatable support member synchronously with the drive shaft, and the rotational movement of the swash plate is converted to the reciprocal movement of the pistons. Thus, a compression cycle, including the suction of a refrigerant gas into the cylinder bores, the compression of the refrigerant gas and the discharge of the compressed refrigerant gas from the cylinder bores, is repeated.

A compressor having a mechanism for changing a displacement as described below is also known.

Specifically, a discharge chamber, in which the compressed refrigerant gas stays temporarily, and the crank chamber are in fluid communication with each other through a gas feed passageway having a control valve. The control valve has the function of adjustably changing the opening area of the gas feed passageway and thereby adjusting the amount of the refrigerant gas at high pressure supplied into the crank chamber from the discharge chamber. By adjusting the feeding amount of the refrigerant gas in discharge pressure in this way, the pressure in the crank chamber is changed, so that the difference between the pressure in the crank chamber exerted on one side of the piston and the pressure in the cylinder bore exerted on the other side of the piston is changed. Along with this change of the difference in the pressure, the inclination angle of the swash plate with respect to a plane vertical to the axis of the drive shaft is adjustably changed thereby to adjust the piston stroke, i.e. the amount of displacement.

The compressor described above comprises many sliding portions such as bearings of the drive shaft, the outer surface of each piston and the inner surface of the corresponding cylinder bore, and the coupling between the swash plate and each piston. In the case where foreign matter is caught in any of these sliding portions, the smooth movement of the particular sliding portion is adversely affected, often resulting in an increased load on the external drive source. Especially, seizing on the sliding portion has a serious effect on the external drive source.

Further, in the compressor described above having the mechanism for changing the displacement, foreign matter intruding into the control valve may be caught in the space between a valve body and a valve hole of the control valve so that it may impair the function of adjusting the opening degree of the opening area thereof. Once the function of adjusting the opening degree of the control valve is impaired in this way, the supply of the refrigerant gas in discharge pressure into the crank chamber fails to be adjusted properly, thereby considerably reducing the accuracy of the adjusted displacement.

Another known compressor includes a filter at the inlet of the refrigerant gas into the compressor from an external refrigerant circuit, at the inlet of the gas feed passageway, or at the other locations, in order to avoid troubles which might be caused by the intrusion of foreign matter.

A mounting configuration for one of these filters, which is mounted at the inlet of the gas feed passageway, for example, is illustrated in FIG. 7.

Specifically, a mounting recess 103 is formed on an inner bottom surface of a discharge chamber 102 defined in an outer peripheral portion of a rear housing 101, and an inlet to the gas feed passageway 104 opens into the mounting recess 103. An inner peripheral surface of the mounting recess 103 is formed with a step 105 at the substantially central portion thereof and an annular groove 106 positioned between the opening and the step 105 of the mounting recess 103. A filter 107 in the form of a circular disk, for example, made of a woven wire, rests on the step 105 and is securely retained there by a snap ring 108 mounted in the annular groove 106.

with the conventional configuration described above, when mounting the filter 107 at the inlet to the gas feed passageway, at first, it should be dropped onto the step 105 in the mounting recess 103. Then, after setting the snap ring 108 into registry with the opening of the mounting recess 103 while reducing the diameter thereof by means of pliers or the like, the snap ring should be released from the force of reducing the diameter thereof and thus fitted into the annular groove 106. Mounting the filter 107 in this way requires skilled work which is difficult to automate and which has to be inevitably performed manually, thereby leading to the problem of a high manufacturing cost for the compressor.

The compressor, whose drive source is the vehicle engine, is generally mounted in the vicinity of the vehicle engine in the engine compartment. Since the space available for arranging the compressor in the engine compartment is limited the demand for a smaller compressor is increasing. A smaller compressor also reduces the size of the opening of the discharge chamber 102 formed with the mounting recess 103. A space is also required to screw a through bolt for securely coupling the housing of the whole compressor on the outer peripheral portion of the rear housing 101. This space forms a protruding portion on the inner peripheral surface of the discharge chamber 102.

On the other hand, a required filtration area sufficient for a predetermined filtering capacity must be maintained. It is therefore difficult to reduce the radial size of the filter 107. The resulting problem is that the location for the filter 107 to be arranged in the rear housing 101 is severely restricted.

An idea for reducing the radial size of the filter 107 while maintaining a required filtration area is to convexly protrude a portion of the filter 107 along the axis thereof. Protrusion of the filter 107 toward the opening of the mounting recess 103, however, makes extremely difficult the work of mounting the snap ring 108. On the other hand, if the filter 107 is protruded toward the bottom of the mounting recess 103, a new problem arises in that foreign matter is liable to accumulate in the protrusion of the filter 107.

SUMMARY OF THE INVENTION

The present invention has been developed in order to solve the above-mentioned problems of the prior art and it is an object thereof to provide a fluid machine in which the step of mounting the filter on the flow passageway can be easily automated with an improved latitude of filter arrangement.

In order to achieve the object described above, according to a first aspect of the invention, there is provided a fluid machine which includes a housing assembly provided with a plurality of pressure chambers, a plurality of working chambers for changing a pressure of a fluid accommodating therein to a predetermined level, and a plurality of communication passageways for providing fluid communication between an external fluid circuit and the pressure chambers or between the pressure chambers, wherein the fluid machine further includes a filter arranged in an opening end of one of the communication passageways and provided with means for securing the filter in the opening end by press fitting or caulking.

In this fluid machine, the filter can be fixedly secured to the housing assembly by the simple work of placing the filter in position corresponding to the opening end of the housing assembly and press fitting the filter directly in the opening end or by the simple work of inserting the filter and then pressing the exposed portion thereof against the housing assembly. Thus, the step of mounting the filter can be easily automated.

In one preferred embodiment of the above-mentioned fluid machine, the filter is arranged in the opening end defined as an inlet to the communication passageway in the direction of the fluid flow.

In this fluid machine, in addition to the advantage described above, the intrusion of foreign matter into the communication passageway can be effectively suppressed. Further, since the filter is pressed against the communication passageway under the pressure of the fluid, the filter is prevented from easily moving out of position.

In another preferred embodiment of the above-mentioned fluid machine, the filter includes a filter member in a three-dimensional shape.

In this fluid machine, in addition to the advantages described above, the filter can be reduced in radial size while maintaining a required filtration area, thereby improving the latitude in the design of the communication passageway.

Further, preferably, at least a portion of the filter member is formed to project from the opening end formed in the housing assembly.

In this fluid machine, in addition to the advantage described above, the filter member can be structured to prevent foreign matter from being accumulated therein, thereby to improve a filter durability.

In a further preferred embodiment of the above-mentioned fluid machine, the fluid machine comprises a compressor for compressing a compressive fluid and the pressure chambers include a suction chamber for accommodating the compressive fluid supplied from the external fluid circuit and a discharge chamber for accommodating the compressive fluid discharged from the working chamber. Preferably, a recess is formed on the inner surface of the discharge chamber and the filter is secured in the recess by press fitting or caulking. More preferably, a part of the filter projects beyond the inner surface of the discharged chamber.

With a compressor for compressing a compressive fluid, i.e. a gas, a sufficient amount of liquid is not always in contact with the sliding surfaces thereof but only a small amount of lubricant is supplied. For this reason, foreign matter attached to the sliding surfaces is sometimes difficult to wash off. In this fluid machine according to preferred embodiment, the bad influence of foreign matter on the fluid machine can be reduced and the advantage described above can be conspicuously exhibited.

Preferably, in the above-mentioned preferred embodiment, at least one of the communication passageway is/are provided with a control valve for adjustably changing the opening area of the communication passageway. More preferably, the filter is arranged at the inlet to the communication passageway provided with the control valve.

This fluid machine has the advantage, in addition to one described above, that the adverse effect that foreign matter may have on the smooth change of the opening area of the communication passage can be prevented.

More preferably, the pressure chambers include a crank chamber, in which a pressure of the compressive fluid accommodated therein is changed by the operation of the control valve and across which a drive shaft is provided, said crank chamber accommodating a cam plate inclinably mounted on the drive shaft, and wherein the working chamber accommodates a piston coupled to the cam plate to be able to move reciprocally therein, whereby the inclination angle of the cam plate with respect to a plane vertical to the axis of the drive shaft, is changed due to the change of difference between the pressure in the crank chamber exerted on one side of the piston and the pressure in the working chamber exerted on the other side of the piston caused by changing the pressure in said crank chamber, thereby to adjustably change the displacement of the fluid machine.

This fluid machine has, in addition to the advantage described above, the advantage that intrusion of foreign matter into the control valve is prevented thereby to ensure the accurate operation of the control valve. As a result, the accurate operation of changing the displacement of the fluid machine can be ensured.

In a further preferred embodiment of the above-mentioned fluid machine, the drive shaft is kept connected to an external drive source.

With the compressor of a clutchless type, as described above, once a malfunction of the control valve occurs, the fluid machine may continue to run while the controllability of the displacement is considerably reduced. In such a situation, the fluid machine may operate with an operating displacement not coincident with the required displacement. For this reason, the advantage of the fluid machine is exhibited especially conspicuously by a compressor of a clutchless type.

In one preferred embodiment, the means for securing the filter comprises a ring arranged at a periphery of the filter.

Preferably, the ring of the filter may have a diameter slightly larger than that of the opening end and the filter may be fixedly secured in the opening end by press fitting.

Also, preferably, the ring may have substantially the same diameter as that of the opening end and be deformed plastically by caulking to engage with a groove formed in the opening end. More preferably, the ring is made of plastically deformably material selected from a group including resin, aluminum, lead and copper.

Also, preferably, the ring has a first elastically deformable engaging means on its periphery, and a second engaging means is provided on the opening end, the second engaging means adapted to engage the first engaging means.

According to a second aspect of the invention, there is provided a fluid machine which includes a housing assembly provided with a plurality of pressure chambers, a plurality of working chambers for changing a pressure of a fluid accommodating therein to a predetermined level, and a plurality of communication passageways for providing fluid communication between an external fluid circuit and the pressure chambers or between the pressure chambers, wherein the fluid machine further includes: a filter arranged in an opening end of one of the communication passageways; and, a securing element to secure the filter in the opening end by the application of a mechanical force to the securing element.

Preferably, the securing element comprises a ring arranged at a periphery of the filter.

Also, preferably, the application of the mechanical force is achieved by press fitting or caulking.

BRIEF DESCRIPTION OF THE DRAWINGS

The above and other objects, features, and advantages of the present invention will be made more apparent from the following description of the preferred embodiments thereof with reference to the accompanying drawings, wherein.

DESCRIPTION OF THE PREFERRED EMBODIMENTS

First Embodiment

A variable displacement swash plate type refrigerant compressor having a single head type piston according to a first embodiment of the present invention will be described with reference to FIGS. 1 to 4.

First, a description will be made of a general configuration of the variable displacement refrigerant compressor (hereinafter simply referred to as the compressor).

Figure 1:
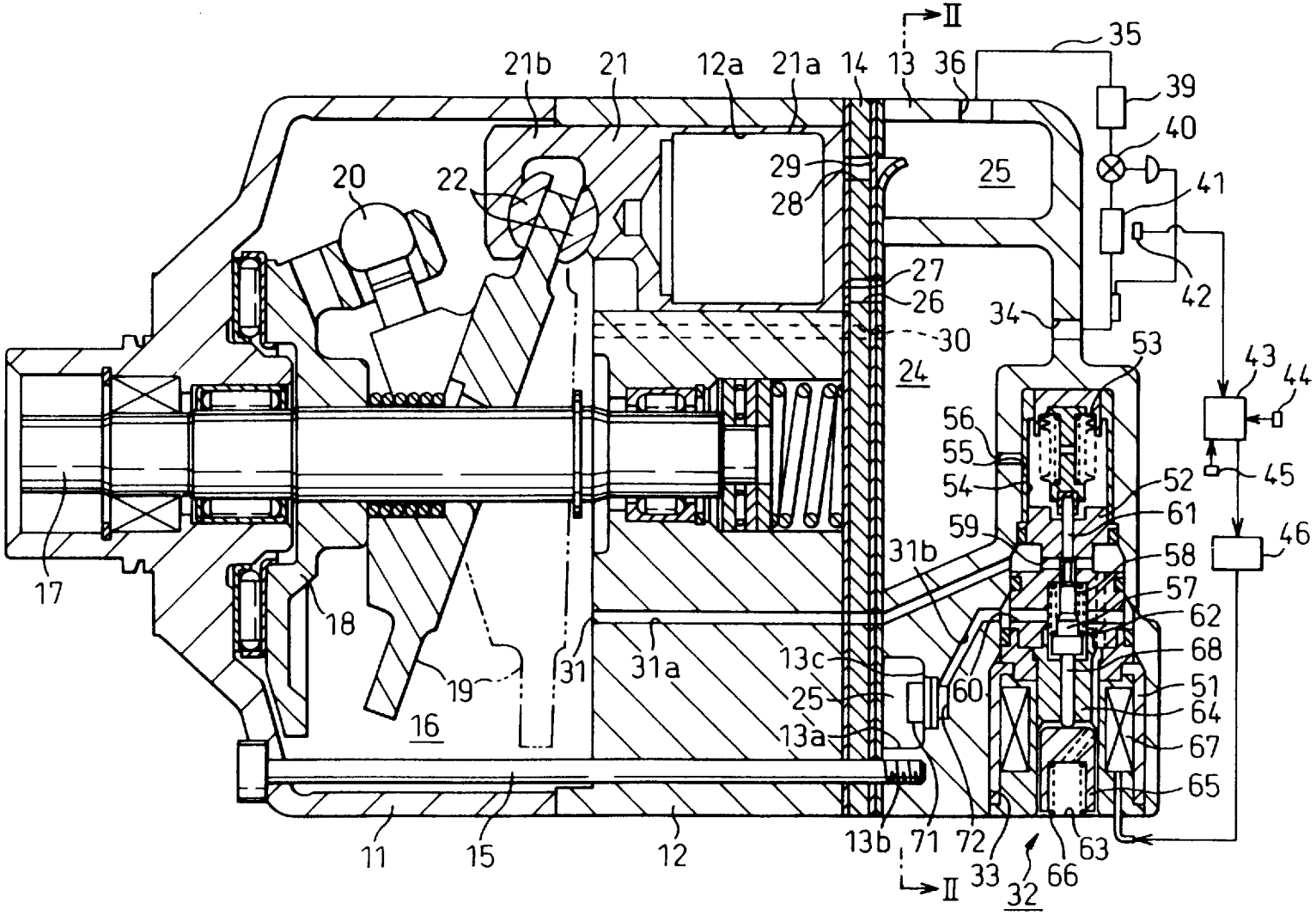
FIG. 1 is a sectional view showing a general configuration of a variable displacement refrigerant compressor according to a first embodiment of the invention.

As shown in FIG. 1, a front housing 11 is coupled to the front end of a cylinder block 12. A rear housing 13 is coupled via a valve plate 14 to the rear end of the cylinder block 12. The front housing 11, the cylinder block 12 and the rear housing 13 are fixedly coupled by through bolts 15 so that they constitute a housing assembly of a compressor.

A crank chamber 16 is defined as a pressure chamber surrounded by the front housing 11 and the cylinder block 12. A drive shaft 17 is rotatably supported between the front housing 11 and the cylinder block 12 across the crank chamber 16. This drive shaft 17 has the front end thereof connected to an external drive source such as a vehicle engine via a pulley and a belt not shown. In this compressor of a clutchless type, the driving power from the vehicle engine is always transmitted to the drive shaft 17 so that the drive shaft 17 is always rotated.

In the crank chamber 16, a rotatable support member 18 is fixed on the drive shaft 17 and a swash plate 19 acting as a cam plate is also slidably fitted thereon. The swash plate 19 is coupled via a hinge mechanism 20 to the rotatable support member 18 to be rotatable synchronously with it. The connecting relationship among the hinge mechanism 20, the swash plate 19 and the drive shaft 17 renders the swash plate 19 slidable with relation to the drive shaft 17 in its axial direction while being inclined with respect to a plane vertical to the axis of the drive shaft 17.

Specifically, when the radial central portion of the swash plate 19 slides toward the cylinder block 12, as indicated by two-dot chain line in FIG. 1, the inclination angle of the swash plate 19 with respect to a plane vertical to the axis of the drive shaft 17 decreases. On the other hand, as indicated by the solid line in FIG. 1, when the radial central portion of the swash plate 19 slides toward the rotatable support member 18, the inclination angle of the swash plate 19 increases.

The cylinder block 12 is formed with a plurality of (for example, six) cylinder bores 12*a*, defined as working chambers, at predetermined spatial intervals along the same circle around the axis of the drive shaft 17. Each cylinder bore 12*a* accommodates the head 21*a* of a corresponding single head type piston 21 able to move reciprocally therein. The neck portion 21*b* of the piston 21 is slidably coupled, via shoes 22, to the outer peripheral portion of the swash plate 19. As a result, the rotational movement of the drive shaft 17 is converted into the longitudinal reciprocating movement of the head portion 21*a* of the piston 21 in the cylinder bore 12*a*, via the rotatable support member 18, the hinge mechanism 20, the swash plate 19 and the shoes 22.

Figure 2:
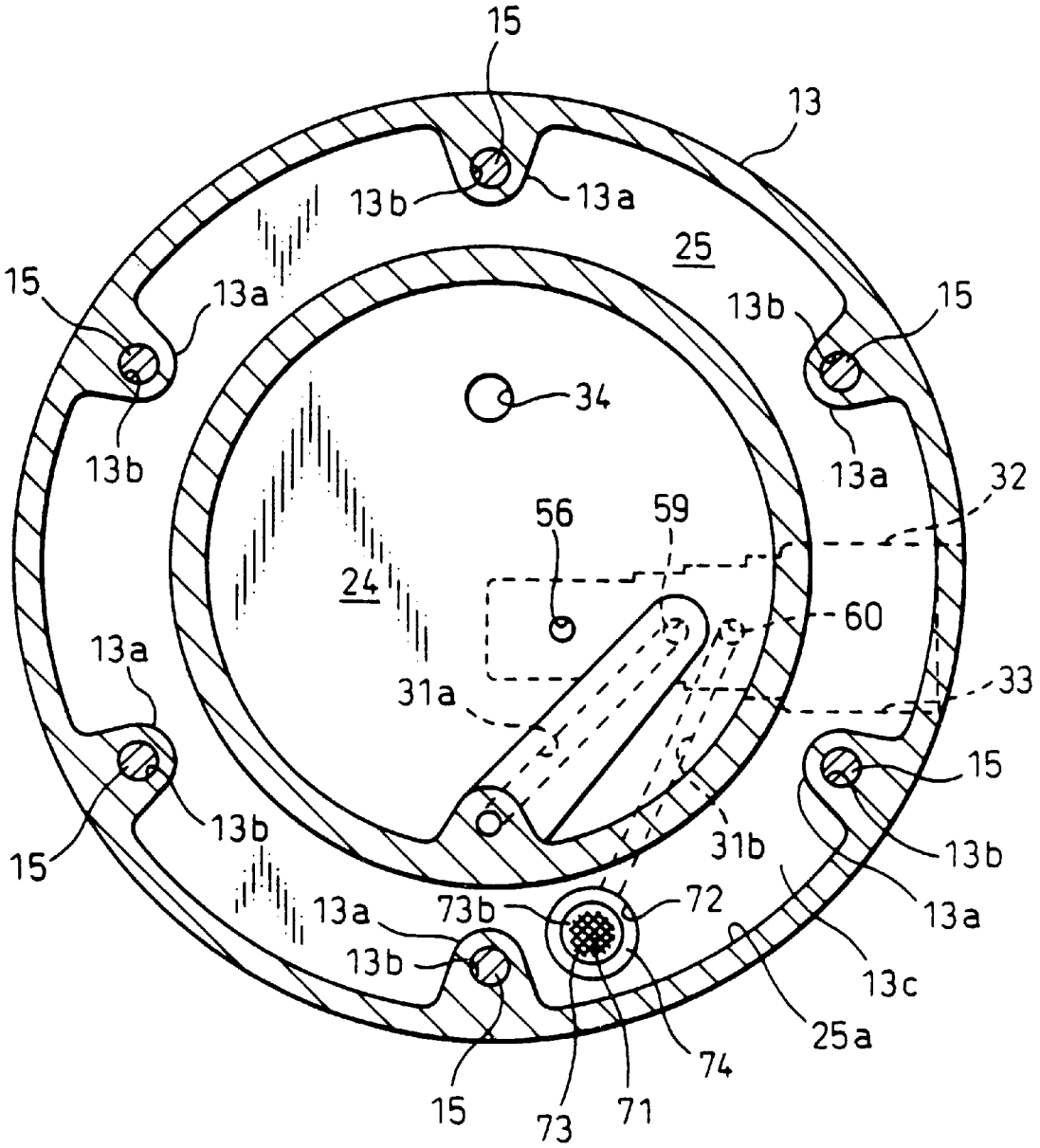
FIG. 2 is a sectional view of the compressor of FIG. 1 taken along the line II—II.
Figure 3:
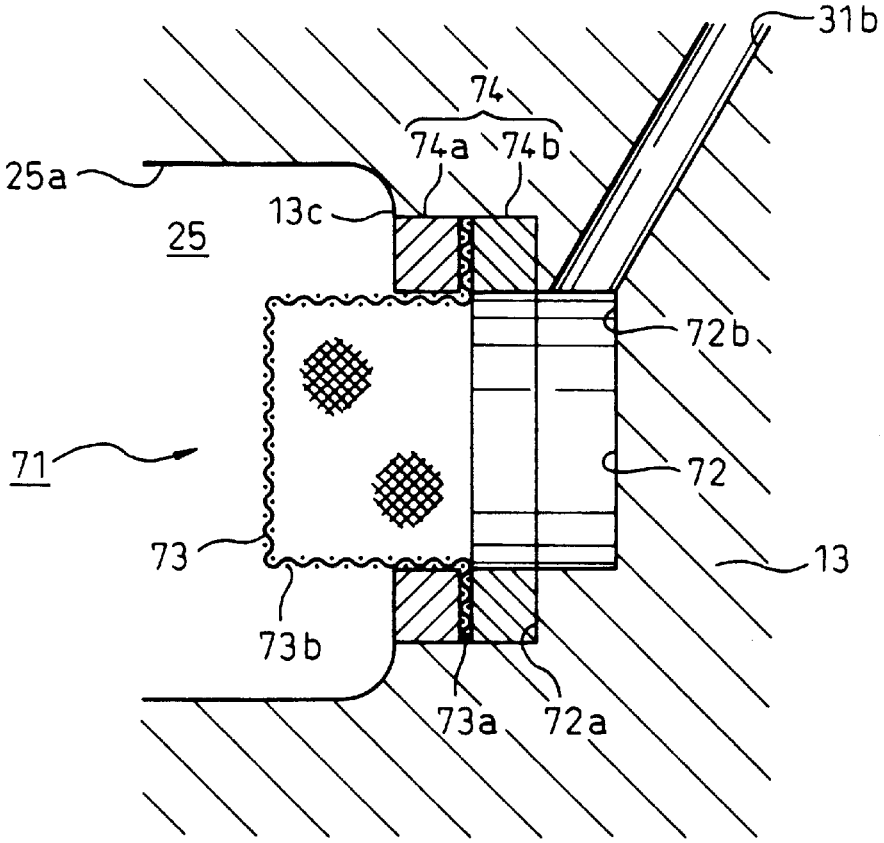
FIG. 3 is an enlarged partial sectional view of the filter mounting structure shown in FIG. 1.
Figure 4:
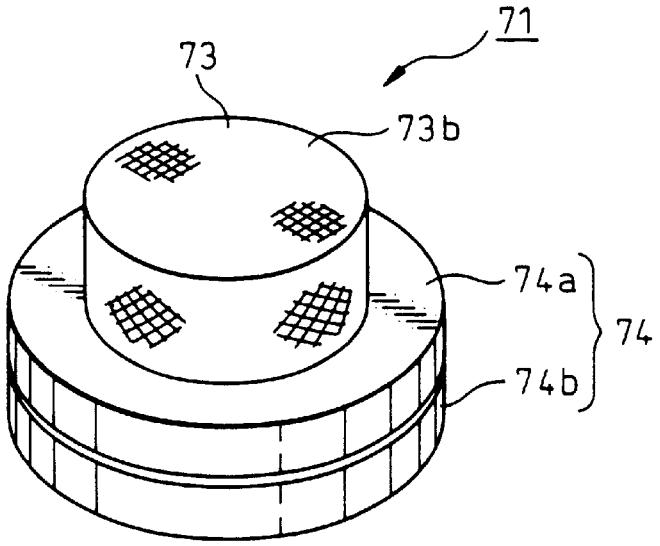
FIG. 4 is an enlarged perspective view of the filter shown in FIG. 1.

As shown in FIGS. 1 and 2, a suction chamber 24, defined as a pressure chamber, is formed at the central portion of the rear housing 13, and a discharge chamber 25, defined as a pressure chamber, is formed on the outer peripheral portion of the rear housing 13. A plurality of protruding portions 13*a* are formed on the inner peripheral wall surface 25*a* of the discharge chamber 25. Each of the protruding portions 13*a* is formed with a threaded hole 13*b* adapted to be screwed with a corresponding through bolt 15.

The valve plate 14 is formed with suction ports 26, suction valves 27, discharge ports 28 and discharge valves 29 corresponding to cylinder bores 12*a*. The suction port 26 provides fluid communication between the suction chamber 24 and each cylinder bore 12*a*, and the suction valve 27 operates to open and close the suction port 26. The discharge port 28 provides fluid communication between the discharge chamber 25 and each cylinder bore 12*a*, and the discharge valve 29 operates to open and close the discharge port 28.

When the drive shaft 17 is driven to be rotated by an external drive source (not shown), and then the piston 21 moves from the top dead center to the bottom dead center, the refrigerant gas in the suction chamber 24 is sucked through the suction port 26 into the cylinder bore 12*a* by pushing open the suction valve 27. The refrigerant gas introduced into the cylinder bore 12*a* is compressed to a predetermined pressure by the movement of the piston 21 from the bottom dead center to the top dead center. The refrigerant gas thus compressed pushes open the discharge valve 29 and is discharged through the discharge port 28 into the discharge chamber 25.

The crank chamber 16 and the suction chamber 24 are in communication with each other through a gas extracting passageway 30 defined as a communication passageway. The discharge chamber 25 and the crank chamber 16 are in communication with each other through a gas feed passageway 31 defined as a communication passageway. As shown in FIGS. 1 and 2, a control valve 32 is connected on the way of the gas feed passageway 31 in order to adjustably change the opening area thereof. This control valve 32 is mounted in a mounting hole 33 formed in the rear end portion of the rear housing 13.

The suction chamber 24 is connected to one end of an external refrigerant circuit 35 through the suction passageway 34 defined as a communication passageway. The discharge chamber 25 is connected to the other end of the external refrigerant circuit 35 through the discharge passageway 36 defined as a communication passageway. This external refrigerant circuit 35 includes a condenser 39, an expansion valve 40 and an evaporator 41. The external refrigerant circuit 35 and the compressor having the configuration described above constitute a refrigeration circuit.

An evaporator temperature sensor 42 is arranged in the vicinity of the evaporator 41 to detect the temperature of the evaporator 41 and to output information of the detected temperature to a control computer 43. The control computer 43 is connected, for example, to a car interior temperature setting device 44, for setting the temperature of the car interior, and to a car interior temperature sensor 45.

The control computer 43 transmits an input current level to a driving circuit 46, based on external signals representing, for example, the car interior temperature preset by the car interior temperature setting device 44, the detected temperature obtained from the evaporator temperature sensor 42 and the detected temperature obtained from the car interior temperature sensor 45. The driving circuit 46 outputs the transmitted input current value to a coil 67 of the control valve 32 described later.

The control valve 32 includes an electromagnetic drive unit 51 and a valve housing 52 which are coupled at the central portion of the length of the control valve 32. A pressure sensing chamber 54 for accommodating a bellows 53 is defined inside the distal end of the valve housing 52. The pressure sensing chamber 54 is in communication with the suction chamber 24 through a pressure sensing hole 55 and a pressure detecting passage 56 defined as a communication passageway. As a result, the suction pressure Ps in the suction chamber 24 is introduced into the pressure sensing chamber 54.

Also, a valve accommodating chamber 58 for accommodating a valve body 57 is defined inside the portion of the valve housing 52 nearer to the electromagnetic drive unit 51. One end of the valve hole 59 opens at the portion of the valve accommodating chamber 58 in opposed relation to the valve body 57. The other end of the valve hole 59 opens to the substantially intermediate portion between the pressure sensing chamber 54 and the valve accommodating chamber 58 on the outer peripheral surface of the valve housing 52. The crank chamber 16 is in communication with the valve hole 59 through a downstream gas feed passageway 31*a*. As a result, with valve hole 59 closed by the valve body 57, the crank chamber pressure Pc in the crank chamber 16 is introduced into the valve hole 59.

On the other hand, the valve accommodating chamber 58 is in communication with the discharge chamber 25 through gas feed hole 60 and an upstream gas feed passageway 31*b*. As a result, the discharge pressure Pd in the discharge chamber 25 is introduced into the valve accommodating chamber 58.

In this way, the gas feed passageway 31 is constituted of the upstream gas feed passageway 31*b*, the gas feed hole 60, the valve accommodating chamber 58, the valve hole 59 and the downstream gas feed passageway 31*a*.

The valve body 57 is formed integrally with a pressure sensing rod 61, whereby the bellows 53 and the valve body 57 are operatively connected with each other. Specifically, when the bellows 53 expands or contracts in response to the change in the suction pressure Ps, an urging force in proportion to the changed suction pressure Ps is transmitted via the pressure sensing rod 61 to the valve body 57.

An opening spring 62 is interposed between the valve body 57 and the inner wall surface of the valve chamber accommodating chamber 58 in opposed relation to the valve body 57. The opening spring 62 forces the valve body 57 to open the valve hole 59 when the bellows 53 and the electromagnetic drive unit 51 are out of operation.

A plunger chamber 63 is defined inside the electromagnetic drive unit 51, and a stationary iron core 64 is fitted in an upper opening of the plunger chamber 63. A movable iron core 65 is arranged inside the plunger chamber 63 and in opposed relation to the stationary iron core 64. A following spring 66 is interposed between the movable iron core 65 and the bottom surface of the plunger chamber 63. The movable iron core 65 is urged toward the valve accommodating chamber 58 by the following spring 66.

A coil 67 is arranged outside the stationary iron core 64 and the movable iron core 65 to cover the iron cores 64, 65. This coil 67 is connected to the driving circuit 46, and generates an electromagnetic force depending on the level of the input current from the driving circuit 46.

The portion of the valve body 57 is formed integrally with an electromagnetic driving rod 68 in opposed relation to the pressure sensing rod 61. The end of the electromagnetic driving rod 68 nearer to the movable iron core 65 is kept in contact with the movable iron core 65 by the urging force of the opening spring 62 and the following spring 66. As a result, the movable iron core 65 and the valve body 57 are operatively connected with each other via the electromagnetic driving rod 68, so that the urging force corresponding to the electromagnetic force generated in the coil 67 is transmitted to the valve body 57.

The operation of changing the displacement of the compressor having the aforementioned configuration will now be described.

For example, in the case where the temperature detected by the car interior temperature sensor 45 is above the preset temperature of the car interior temperature setting device 44, the control computer 43 instructs the driving circuit 46 to supply a predetermined current to the coil 67 of the control valve 32. As soon as a current begins to be supplied to the coil 67, the attraction force (electromagnetic force) depending on the input current level is generated between the iron cores 64 and 65. This attraction force is transmitted to the valve body 57 as a load imposed toward the valve hole 59 against the urging force caused by the opening spring 62, i.e.

a load imposed in such a direction as to decrease the opening area of the gas feed passageway 31.

The bellows 53, on the other hand, is expanded and contracted in response to the change in the suction pressure Ps introduced into the pressure sensing chamber 54 through the pressure detecting passageway 56. In response to the expansion or contraction of the bellows 53, the load transmitted to the valve body 57 via the pressure sensing rod 61 is changed.

Specifically, when the suction pressure Ps increases, the bellows 53 is contracted, so that the load is transmitted to the valve body 57 to move the valve body 57 toward the valve hole 59, i.e. in such a direction as to decrease the opening area of the gas feed passageway 31. When the suction pressure Ps decreases, on the other hand, the bellows 53 is expanded, so that the load is transmitted to the valve body 57 to move the valve body 57 away from the valve hole 59, i.e. in such a direction as to increase the opening area of the gas feed passageway 31. Thus, the control valve 32 energizes the valve body 57 in accordance with the total force based on the load imposed by the attraction force between the stationary iron core 64 and the movable iron core 65, the load imposed by the expansion/contraction of the bellows 53, the urging force based on the opening spring 62 and the following spring 66, and other forces, thereby defining the opening area of the gas feed passageway 31.

When the opening area of the gas feed passageway 31 in the control valve 32 becomes smaller, a smaller amount of refrigerant gas is supplied from the discharge chamber 25 through the gas feed passageway 31 to the crank chamber 16. The refrigerant gas in the crank chamber 16 always flows out at a predetermined rate through the extracting passageway 30 into the suction chamber 24, and therefore the pressure Pc in the crank chamber 16 decreases accordingly. Thus, the difference between the pressure Pc in the crank chamber 16 exerted on one side of the piston 21 and the pressure in the cylinder bore 12*a* exerted on the other side of the piston 21 is decreased, thereby increasing the inclination angle of the swash plate 19. As a result, the stroke of the piston 21 increases to increase the displacement.

On the other hand, when the opening area of the gas feed passageway 31 in the control valve 32 becomes larger, a greater amount of refrigerant gas is supplied from the discharge chamber 25 to the crank chamber 16, thereby increasing the pressure Pc in the crank chamber 16. Thus, the difference between the crank chamber pressure Pc and the pressure in the cylinder bore 12*a* is increased thereby reducing the inclination angle of the swash plate 19. As a result, the stroke of the piston 21 decreases to decrease the displacement.

In the case where a demand for cooling the interior air is great, for example, the difference between the temperature detected by the car interior temperature sensor 45 and the temperature preset by the car interior temperature setting device 44 increases. The control computer 43 instructs the driving circuit 46 to increase the level of the input current for the coil 67 of the control valve 32, based on the larger difference between the detected temperature and the preset temperature. As a result, the attraction force between the stationary iron core 64 and the movable iron core 65 increases so that the load imposed on the valve body 57 in such a direction as to reduce the opening area of the gas feed passageway 31 in the control valve 32 increases.

Thus, the control valve 32 activates the valve body 57 by the bellows 53 to open/close the valve hole 59 in order to set a lower suction pressure Ps as a target (set suction pressure). In other words, by increasing the level of the input current for the coil 67, the control valve 32 adjustably changes the displacement of the compressor so as to maintain a lower suction pressure Ps.

In contrast, in the case where a demand for cooling the interior air is small, the difference between the temperature detected by the car interior temperature sensor 45 and the temperature preset by the car interior temperature setting device 44 decreases. The control computer 43 instructs the driving circuit 46 to generate a small level of the input current for the coil 67 of the control valve 32, depending on the smaller difference between the detected temperature and the preset temperature. As a result, the attraction force between the stationary iron core 64 and the movable iron core 65 decreases so that the load imposed on the valve body 57 in such a direction as to reduce the opening area of the gas feed passageway 31 in the control valve 32 decreases.

Thus, the control valve 32 activates the valve body 57 by the bellows 53 to open and close the valve hole 59 in order to set a higher suction pressure Ps as a set suction pressure. In other words, by decreasing the level of the input current for the coil 67, the control valve 32 adjustably changes the displacement of the compressor so as to maintain a higher suction pressure Ps.

As described above, the operation of the bellows 53 of the control valve 32 for opening and closing the gas feed passageway 31 changes depending on the level of the input current for the coil 67. Provision of such control valve 32 enables the compressor to play the role of changing the refrigerating capacity of the refrigeration circuit.

The features of the present embodiment will now be described below.

As shown in FIGS. 1 to 4, a circular mounting recess 72 for mounting the filter 71 is formed in the vicinity of a lower protruding portion 13*a* on the inner bottom surface 13*c* of the rear housing 13. The mounting recess 72 is formed with a step 72*a* in a portion somewhat deeper than the middle of the depth thereof and the upstream gas feed passageway 31*b* opens to the bottom 72*b* of the recess 72. In other words, the mounting recess 72 is defined as a refrigerant gas inlet to the gas feed passageway 31 and at the same time an opening end of the gas feed passageway in the rear housing 13.

The filter 71 includes a filter member 73 made of a woven wire (that is, a mesh filter member) formed in a shape of a cylinder with one end covered and two support metal rings 74 formed in a shape corresponding to that of the opening of the mounting recess 72. A flange portion 73*a* is extended from the periphery of an opening end (opposed to the covered end) of the covered cylindrical filter member 73. The upper support ring 74*a* and the lower support ring 74*b*, which constitute the support ring 74, are spot welded to each other with the flange portion 73*a* held therebetween. Thus, the filter member 73 and the support ring 74 are integrated with each other.

Under this condition, the head 73*b* of the filter member 73 is convexly protruded by a predetermined height from the upper support ring 74*a*. As a result, when the filter 71 is mounted in the mounting recess 72, the head 73*b* of the filter member 73 projects beyond the inner bottom surface 13*c* of the rear housing 13.

The support ring 74 is formed such that the outer diameter thereof is slightly larger than the inner diameter of the opening of the mounting recess 72. Also, a tapered surface progressively reduced in diameter toward the end nearer to the recess 72 along the mounting direction is formed on the outer peripheral edge of the lower support ring 74*b* nearer to the bottom 72*b* when mounted in the mounting recess 72. This enables the filter 71 to be mounted and secured in the mounting recess 72 by press fitting. When the filter 71 is mounted in the mounting recess 72, the end surface of the lower support ring 74*b* rests on the step 72*a* of the mounting recess 72.

When mounting the filter 71 in the mounting recess 72, the lower support ring 74*b* is placed in position corresponding to the opening of the mounting recess 72, while the upper support ring 74*a* is press fitted by being pressed against the rear housing 13 by means of a suitable jig.

Thus, according to the first embodiment having the above-mentioned configuration, the following advantages are obtained.

(a) In the compressor according to the first embodiment, the filter 71 is fixedly press fitted in the mounting recess 72 defined as an opening end of the gas feed passageway 31 in the rear housing 13.

This enables the filter 71 to be fixedly secured to the rear housing 13 by the simple work of placing the filter 71 in position corresponding to the mounting recess 72 and press fitting the filter 71 directly in the mounting recess 72. As a result, the step of mounting the filter 71 can be easily automated. Also, no annular groove is required in the mounting recess 72 and thus the shape of the mounting recess 72 can be simplified thereby to facilitate the machining operation. The manufacturing cost of the compressor can thus be reduced.

(b) In the compressor according to the first embodiment, the filter 71 is arranged at the refrigerant gas inlet to the gas feed passageway 31.

As a result, intrusion of foreign matter into the gas feed passageway 31 can be effectively suppressed. Also, the filter 71, which is pressed against the gas feed passageway 31 under the pressure of the refrigerant gas, is prevented from easily moving out of position.

(c) In the compressor according to the first embodiment, the filter 71 includes the filter member 73 in a shape of a cylinder with one end covered.

As a result, the support ring 74 of the filter 71 can be easily reduced in radial size while maintaining a required filtration area sufficient for a predetermined filtering capacity, so that the latitude of the design of the gas feed passageway 31 and a configuration of a portion around it can be improved.

(d) In the compressor according to the first embodiment, the head 73*b* of the filter member 73 of the filter 71 projects into the discharge chamber 25 and is exposed to it.

As a result, the filter 71 can be structured so that foreign matter is not easily accumulated on the filter member 73 and that the foreign matter, if attached, is easily removed by the refrigerant gas flow in the discharge chamber 25. Thus, the durability of the filter 71 can be improved and its improved durability contributes to a longer life of the compressor.

(e) In the compressor according to the first embodiment, the filter 71 having the advantages described in (a) to (d) is mounted at the inlet to the gas feed passageway 31.

A compressor for compressing a refrigerant gas has many sliding surfaces especially in the crank chamber 16, such as the bearings of the drive shaft 17, the rotatable support member 18 and others, the connecting portion between the swash plate 19 and the piston 21, and the portion between the piston 21 and the cylinder bore 12*a*. These sliding surfaces are not always contacted by a great amount of liquid but only by a small amount of lubricant. Therefore, foreign matter, if attached to the sliding surfaces, may not be easily washed off.

In contrast, in the compressor according to the first embodiment, foreign matter which can give rise to various troubles on the sliding surfaces is removed by the filter 71 and prevented from being carried by the flow of the refrigerant gas from the discharge chamber 25 into the crank chamber 16. Thus, troubles such as the seizing of the various sliding surfaces which otherwise might occur can be effectively suppressed, and thereby the stable operating conditions of the compressor can be ensured while at the same time improving the durability of the compressor.

(f) In the compressor according to the first embodiment, the pressure Pc in the crank chamber 16 is changed in response to the operation of the control valve 32, and this change of the crank chamber pressure Pc in turn changes the difference between the pressure in the crank chamber 16 exerted on one side of the piston 21 and the pressure in the cylinder bore 12*a* exerted on the other side of the piston 21. Based on the change of the difference in the pressure, the inclination angle of the swash plate 19 is changed with respect to a plane vertical to the axis of the drive shaft and the resulting change of the stroke of the piston 21 changes the displacement of the compressor.

As a result, in the event that foreign matter intrudes into the control valve 32 and is caught in the gap between the valve body 57 and the valve hole 59, the sliding portion of the pressure sensing rod 61, the sliding portion of the electromagnetic driving rod 68 and others, it may be difficult for the control valve 32 to accurately adjust the opening area of the gas feed passageway 31. Under such a condition, the difference in pressure cannot be easily adjusted, thereby making it difficult to control the displacement of the compressor.

In contrast, in the compressor according to the first embodiment, the filter 71 mounted at the inlet to the gas feed passageway 31 effectively blocks the intrusion of foreign matter into the control valve 32. This prevents the trouble, which otherwise might be caused by the foreign matter intruding into the control valve 32, to ensure the accurate operation of the control valve 32. Thus, it is possible to ensure the operation for accurately changing the displacement of the compressor.

In addition, the control valve 32 is required to accurately control the pressure in the crank chamber 16, and therefore the valve body 57 operates very delicately. Further, the clearance between the valve body 57 and the valve hole 59 is very small. The control valve 32 is easily clogged, therefore, by the foreign matter which may intrude into the control valve 32. Removing the foreign matter at a position upstream of the control valve 32 thus has an especially great effect.

(g) In the compressor according to the first embodiment, the drive shaft 17 is always connected to an external drive source. Once the malfunction occurs in the control valve 32, a compressor of a clutchless type may continue to operate with the considerably reduced controllability of the displacement. In such a situation, the operation may be carried out with the operating displacement not coincident with the required displacement.

The configuration of the filter 71 having the advantages described in (a) to (f), therefore, exhibits an especially conspicuous effect when employed for the compressor of the clutchless type.

Second Embodiment

A second embodiment of the invention will now be described primarily with reference to the differences from the first embodiment.

Figure 5A:
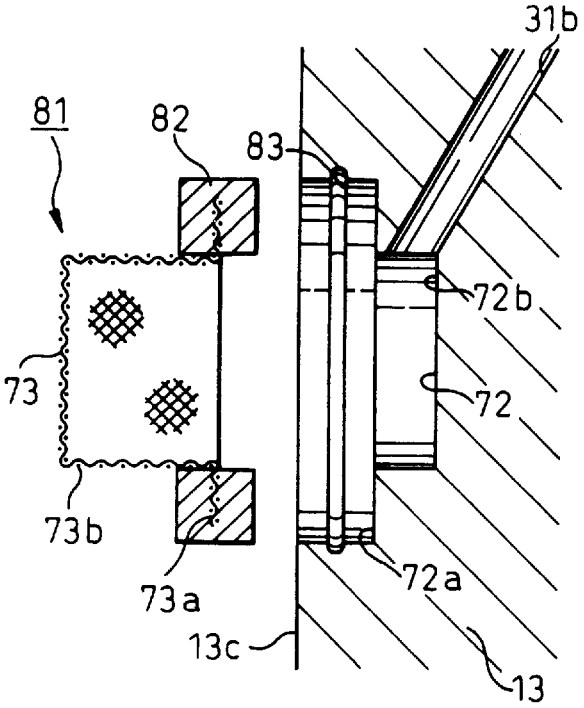
FIG. 5A is an enlarged partial sectional view of the filter mounting structure before the filter is mounted according to a second embodiment of the present invention.
Figure 5B:
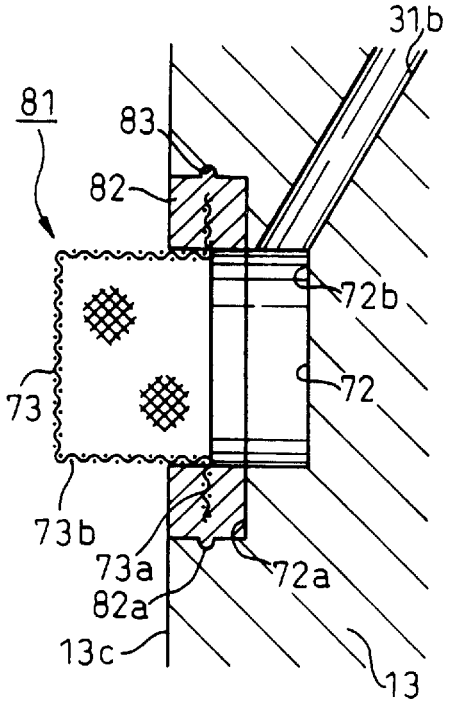
FIG. 5B is an enlarged partial sectional view of the filter mounting structure after the filter is mounted according to the second embodiment.

As shown in FIG. 5A, a filter 81 according to the second embodiment has a flange portion 73*a* of a filter member 73 integrally formed with a support ring 82 of resin by method of die forming and others. Also, an annular groove 83 is formed at the center of the inner peripheral surface between the step 72*a* and the opening of the mounting recess 72. The outer diameter of the support ring 82 is formed such that it is substantially equal to the inner diameter of the opening of the mounting recess 72. As shown in FIG. 5B, the filter 81 is fixedly secured in the mounting recess 72 by engagement between the expansion 82*a* of the support ring 82 expanded and deformed by caulking and the annular groove 83 of the mounting recess 72.

In mounting the filter 81, the support ring 82 is inserted into the mounting recess 72 so that the end surface of the support ring 82 rests on the step 72*a*. Under this condition, the support ring 82 is pressed against the rear housing 13 using a suitable jig, thereby expanding a part of the outer peripheral surface of the support ring 82 into the annular groove 83 of the mounting recess 72. As a result, the filter 81 is fixedly secured on the rear housing 13 by the engagement between the expansion 82*a* of the support ring 82 and the annular groove 83 of the mounting recess 72.

Thus, the second embodiment having the configuration described above, in addition to the advantages substantially similar to (b) to (g) described regarding the first embodiment, has the following advantages.

(h) In the compressor according to the second embodiment, the filter 81 is fixedly secured by caulking in the mounting recess 72 defined as an opening end of the gas feed passageway 31 in the rear housing 13.

As a result, the filter 81 can be fixedly secured on the rear housing 13 by the simple operation of inserting the filter 81 in the mounting recess 72 and pressing its support ring 82 against the rear housing 13. This allows the step of mounting the filter 81 to be easily automated.

Modification

Each embodiment of the invention described above can be modified in any of the following manners.

The filter 71, 81, which is mounted in the mounting recess 72 defined as an inlet to the gas feed passageway 31 in each embodiment described above, may alternatively be mounted in a mounting recess 72 formed at the inlet of the pressure detecting passageway 56 facing the suction chamber 24.

In such a case, the adjustment and transmission of the urging force applied to the valve body 57 in response to the change in the suction pressure Ps is prevented from being adversely affected by the foreign matter which may attach to the bellows 53, the pressure sensing rod 61 and surrounding components thereof.

In each of the embodiments described above, the filter 71, 81, which is mounted in the mounting recess 72 defined as the inlet to the gas feed passageway 31, may alternatively be mounted in the mounting recess 72 formed on the connection of the suction passageway 34 to the external refrigerant circuit 35.

In such a case, intrusion of foreign matter from the external refrigerant circuit 35 into the compressor can be prevented.

Figure 6:
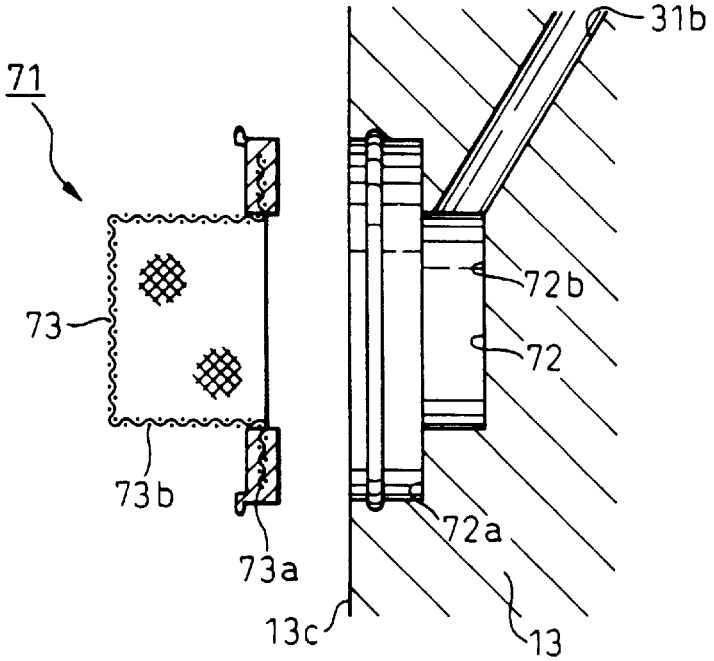
FIG. 6 is an enlarged partial sectional view of a modification of the filter mounting structure shown in FIG. 3.
Figure 7:
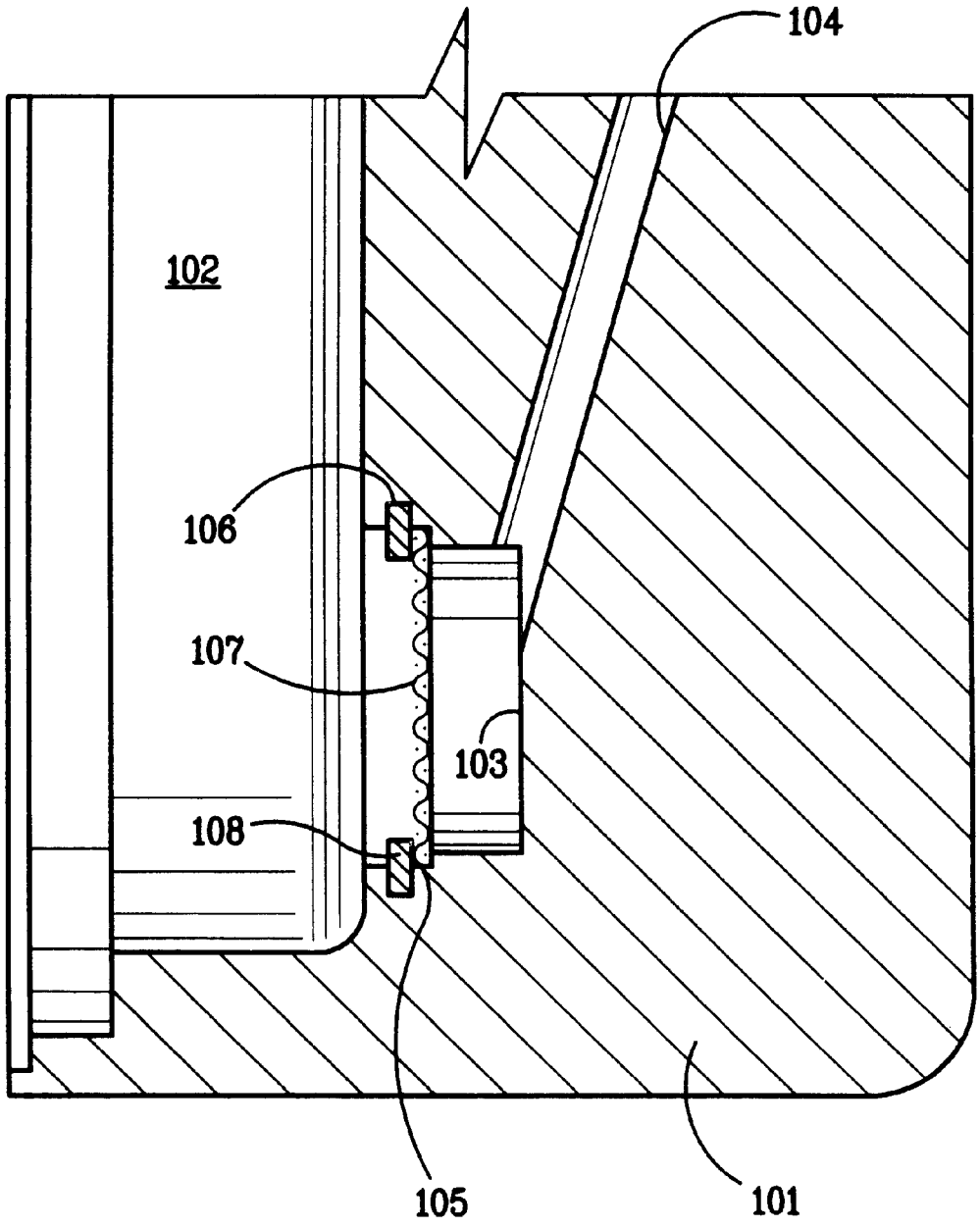
FIG. 7 Prior Art
FIG. 7 is an enlarged partial sectional view of the conventional filter mounting structure.

In the filter 71 according to the first embodiment, a first engaging portion such as a hook adapted to be elastically deformed when the filter 71 is press fitted may be provided on the outer peripheral surface of the support ring 74, as shown in FIG. 6, while at the same time forming, on the inner peripheral surface of the mounting recess 72, a second engaging portion such as a groove or a recess adapted to engage the first engaging portion.

This arrangement enables the filter 71 to be secured more fixedly in the mounting recess 72.

In the filter 81 according to the second embodiment, a ring of a relatively soft metal such as aluminum, lead, copper or the like which can be die formed plastically by a mechanical force such as a pressing force when mounting the filter 81 may be provided on the outer periphery of the support ring 82. Alternatively, the support ring 82, for example, can be formed of a metal by method of die forming and others. The metal can be deformed plastically by a pressing force when mounting the filter 81.

This arrangement also have a substantially similar effect to the second embodiment.

In each of aforementioned embodiments, the drive shaft 17 is kept operatively coupled with an external drive source. Instead, the drive shaft 17 may be operatively coupled to an external drive source in a manner disconnectable via an electromagnetic clutch or the like. Further, the drive shaft 17 and the external drive source may be disconnected depending on whether the car interior is required to be cooled or not.

Also, a switch for activating an air-conditioning system may be arranged in the car interior, so that turning it on/off can connect/disconnect the drive shaft 17 with/from the external drive source and so that the drive shaft 17 can be kept operatively coupled with the external drive source by turning on the switch. In such a case, the frequency of the on/off operation of the electromagnetic clutch can be considerably reduced, thereby improving the riding comfort of the vehicle.

Instead of forming the filter member 73 of the filter 71, 81 in the shape of a cylinder with one end covered, the filter member 73 can be formed, for example, in the three-dimensional shape such as a polygonal cylinder with one end covered, or a cylinder with a star-shaped or gear-shaped section, a cone, a polygonal cone, a substantial hemisphere or a substantial hemipheroid or the like.

In each of the aforementioned embodiments of the invention, the compressor is provided which comprises the control valve 32 for controlling the displacement based on both the change in the suction pressure Ps and a signal from a source external to the compressor. Alternatively, a compressor may be provided which has a control valve for controlling the displacement based on either the change of the suction pressure Ps or a signal from a source external to the compressor.

In each of the embodiments described above, a compressor is provided which has the control valve 32 for changing the displacement by changing the amount of the refrigerant gas supplied from the discharge chamber 25 to the crank chamber 16. Alternatively, a compressor may be provided which has a control valve for changing the displacement by changing the amount of the refrigerant gas extracted from the crank chamber 16 to the suction chamber 24. In such a case, the control valve is arranged in the extracting passageway 30, and the filter 71, 81 is mounted at the inlet to the extracting passageway 30 facing the crank chamber 16 on the wall surface of the cylinder block.

In each of the embodiments described above, the invention is embodied as a configuration in which a filter is fixedly secured at the inlet to the gas feed passageway 31 of the variable displacement swash plate type refrigerant compressor having a single head type piston. Alternatively, the invention can be embodied by a configuration in which a filter is fixedly secured at the inlet to the flow passageway formed in a housing assembly of a liquid pump such as a hydraulic pump as well as a swash plate type compressor having a two-head type piston, a wave cam type compressor of, a wobble type compressor, a scroll type compressor or a vane type compressor.

These fluid machines can be either of a variable displacement type or of a fixed displacement type. Also, these fluid machines can be either of what is called a clutchless type with the drive shaft thereof kept operatively connected with an external drive source, or of a type having a drive shaft disconnectable from an external drive source via a clutch.

According to any of these configurations, a substantially similar effect to the described embodiments can be obtained.

As described above in detail, according to the invention, the step of mounting the filter can be easily automated and thereby the manufacturing cost of the fluid machine can be reduced.

While the invention has been described with reference to specific embodiments chosen for purpose of illustration, it should be apparent that numerous modifications could be made thereto by those skilled in the art without departing from the basic concept and scope of the invention as claimed in the accompanying claims.

We claim:

1. A fluid machine comprising a housing assembly provided with a plurality of pressure chambers, a plurality of working chambers for changing a pressure of a fluid accommodating therein to a predetermined level, and a plurality of communication passageways for providing fluid communication between an external fluid circuit and said pressure chambers or between said pressure chambers, wherein said pressure chambers include a discharge chamber for accommodating a compressive fluid discharged from said working chamber and wherein said fluid machine further comprises a filter arranged in an opening end of one of said communication passageways on the inner surface of said discharge chamber, said filter including a mesh filter member in a three-dimensional shape and a securing device sized or deformable so as to secure said filter in said opening end by at least one of press fitting and caulking, most of said mesh filter member projecting beyond said inner surface of said discharge chamber and exposed to said discharge chamber.

2. The fluid machine according to claim 1, wherein a recess is formed on the inner surface of said discharge chamber and said filter is secured in said recess by press fitting or caulking.

3. The fluid machine according to claim 1, wherein at least one of said communication passageways is/are provided with a control valve for adjustably changing the opening area of said communication passageway.

4. The fluid machine according to claim 3, wherein said filter is arranged at the inlet to said communication passageway provided with said control valve.

5. The fluid machine according to claim 3, wherein said pressure chambers include a crank chamber, in which a pressure of the compressive fluid accommodated therein is changed by the operation of said control valve and across which a drive shaft is provided, said crank chamber accommodating a cam plate inclinably mounted on said drive shaft, and wherein said working chamber accommodates a piston coupled to said cam plate to be able to move reciprocally therein, whereby the inclination angle of said cam plate with respect to a plane vertical to the axis of said drive shaft is changed due to the change of the difference between the pressure in said crank chamber exerted on one side of said piston and the pressure in said working chamber exerted on the other side of said piston caused by changing the pressure in said crank chamber, thereby to adjustably change the displacement of said fluid machine.

6. The fluid machine according to claim 5, wherein said drive shaft is kept connected to an external drive source.

7. The fluid machine according to claim 1, wherein said securing device comprises a ring arranged at a periphery of said filter.

8. The fluid machine according to claim 7, wherein said ring of said filter has a diameter slightly larger than that of said opening end and said filter is fixedly secured in said opening end by press fitting.

9. The fluid machine according to claim 1, wherein said ring has substantially the same diameter as that of said opening end and is deformed plastically by caulking to engage with a groove formed in said opening end.

10. The fluid machine according to claim 9, wherein said ring is made of plastically deformable material selected from a group including resin, aluminum, lead and copper.

11. The fluid machine according to claim 7, wherein said ring has a first elastically deformable engaging means on its periphery, and a second engaging means is provided on said opening end, said second engaging means adapted to engage said first engaging means.

12. A fluid machine comprising a housing assembly provided with a plurality of pressure chambers, a plurality of working chambers for changing a pressure of a fluid accommodating therein to a predetermined level, and a plurality of communication passageways for providing fluid communication between an external fluid circuit and said pressure chambers or between said pressure chambers, wherein said pressure chambers include a discharge chamber for accommodating a compressive fluid discharged from said working chamber and wherein said fluid machine further comprises:

a filter arranged in an opening end of one said communication passageways on the inner surface of said discharge chamber, said filter including a mesh filter member in a three-dimensional shape; and, a securing element sized or deformable so as to secure said filter in said opening end by the application of a mechanical force to said securing element sufficient to secure said filter in said opening end;

wherein most of said mesh filter member projecting beyond said inner surface of said discharge chamber and exposed to said discharge chamber.

13. The fluid machine according to claim 12, wherein said securing element comprises a ring arranged at a periphery of said filter.

14. The fluid machine according to claim 12, wherein said application of the mechanical force causes said securing element to secure said filter in said opening end by a press fit or a caulked fit.

15. The fluid machine according to claim 1, wherein the mesh filter member is cup-shaped.

16. The fluid machine according to claim 9, wherein said ring and said filter are integrated.

* * * * *